US006281182B1

(12) United States Patent
Leonard et al.

(10) Patent No.: US 6,281,182 B1
(45) Date of Patent: Aug. 28, 2001

(54) ACIDIC CLEANING COMPOSITION COMPRISING A GLYCOL ETHER MIXTURE

(75) Inventors: Isabelle Leonard, Voroux-lez-Liers; Didier Dormal, Aywaille, both of (BE)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 09/543,917

(22) Filed: Apr. 6, 2000

(51) Int. Cl.[7] ..... C11D 1/86; C11D 1/94; C11D 3/43

(52) U.S. Cl. ..... 510/235; 510/238; 510/362; 510/384; 510/405; 510/421; 510/433; 510/504; 510/432; 510/242

(58) Field of Search ..... 510/235, 238, 510/362, 384, 405, 421, 433, 504, 432, 242

(56) References Cited

U.S. PATENT DOCUMENTS 5,912,223 * 6/1999 Drapier ..... 510/417
6,121,224 * 9/2000 Foneny et al. ..... 510/384

* cited by examiner

*Primary Examiner*—Yogendra N. Gupta
*Assistant Examiner*—Charles Boyer
(74) *Attorney, Agent, or Firm*—Richard E. Nanfoldt

(57) ABSTRACT

An improvement is described in microemulsion compositions which are especially effective in disinfecting the surface being cleaned and in the removal of oily and greasy soil without leaving streaks which contains a mixture of nonionic surfactants, an anionic surfactant, an amphoteric surfactant, a disinfectant agent, a proton donating agent, a water soluble solvent, and water.

4 Claims, No Drawings

ACIDIC CLEANING COMPOSITION COMPRISING A GLYCOL ETHER MIXTURE

FIELD OF THE INVENTION

This invention relates to an improved multi purpose liquid cleaner in a microemulsion form, to be used neat, in particular for cleaning and disinfecting hard surfaces and which is effective in sanitizing surfaces, in removing grease soil and also dries fast leaving the surfaces streak free.

BACKGROUND OF THE INVENTION

Disinfectant composition based on cationic and nonionic are well known. However, these compositions while very efficient in disinfecting surfaces, generally do not remove grease and oil as desired; hence, leaving residues and streaks on surfaces. Addition of an efficient anionic surfactant cleaner, to the cationic surfactant, either creates instability problems or deactivates the disinfectant behavior of the cationic. Moreover, most cationic compositions are not environmentally friendly. Anionic and nonionic mixtures have a good grease removal properties, but do not perform at all to sanitize the surface being cleaned.

SUMMARY OF THE INVENTION

The instant compositions are cationic free and exhibit good grease removal properties combined with excellent disinfecting properties and the compositions do not leave streak or residue on the surface being cleaned.

The described compositions are to be used mainly neat in a spray form. The compositions contain a lower level of surfactant than current all purpose cleaning compositions and have a richer level of solvent than surfactant. In order to have a product which leaves the surfaces shiny after cleaning, the instant compositions are builder free.

A safe solvent system used in the instant compositions which has been found effective are glycol ethers such as propylene glycol butyl ether (PNB) alone or in combination with ethanol. PNB brings a significant benefit in degreasing performance and also promotes a fast drying out of the surface which has been cleaned. Oily material such as essential oil or perfume, when added to a composition, usually increase the streaks on surfaces.

The combination of a glycol ether with the surfactant system of the present invention allows a faster water film dry out time than obtained with current commercial spray formulations. It is important to select the perfume such as an essential oil not only to satisfy the cosmetic and the marketing needs, but also to have a minimum of residue left on the surface being cleaned. The selection of essential oils is also important because not only they will communicate the efficacy of the product to the consumer but also because they are effective bactericide.

In one aspect, the invention generally provides a stable, clear multi purpose, hard surface cleaning composition especially effective in disinfecting the surface being cleaned and in the removal of oily and greasy oil while a fast dry out time and without leaving streaks on the surface being cleaned. The compositions include approximately, on a weight basis:

from 0 to 10% of a nonionic surfactant formed from a $C_8$–$C_{18}$ alkanol and about 6 to about 9, preferably about 7 to about 8.5 moles of ethylene oxide;

0.1% to 4% of an ethoxylated nonionic surfactant formed from a $C_9$–$C_{11}$ alkanol and about 2 to about 3 moles of ethylene oxide;

0.1 % to 10% of an amphoteric surfactant;

from 0 to 5%, more preferably 0.1 to 3% of an anionic surfactant from 0 to 4%, more preferably 0.1% to 1% of at least one disinfecting agent such as essential oil or perfume;

from 0.1 to 10% of at least one amphoteric surfactant;

0.1% to 5%, more preferably 0.3% to 3% of a proton donating agent;

0 to 6% of at least a water soluble solvent which is a $C_1$–$C_4$ alkanol;

0 to 1.5 %, more preferably 0.3% to 1.5% of triethanol amine;

1% to 10% of a blend of water soluble glycol ethers; and the balance being water.

DETAILED DESCRIPTION OF THE INVENTION

The present invention relates to a stable hard surface cleaning composition approximately by weight:

0% to 10% of an ethoxylated nonionic surfactant formed from a $C_8$–$C_{18}$ alkanol and about 6 to about 9, preferably about 7 to about 8.5 moles of ethylene oxide;

0.1 % to 4% of an ethoxylated nonionic surfactant formed from a $C_9$–$C_{11}$ alkanol and about 2 to about 3 moles of ethylene oxide;

0 to 5%, more preferably 0.1 to 3% of an anionic surfactant;

0 to 4 %, more preferably 0.1% to 1% of at least one disinfecting agent such as a essential oil or perfume, 0.1 % to 10% of an amphoteric surfactant, 0.5% to 5% of a propylene glycol alkyl ether, wherein the alkyl group has 1 to 5 carbon atoms, such as propylene glycol N-butyl ether;

0.5% to 5% of an ethylene glycol alkyl ether, wherein the alkyl group has 1 to 5 carbon atoms or a diethylene glycol alkyl ether, wherein the alkyl group has 1 to 5 carbon atoms such as diethylene N-butyl ether;

0 to 6%, more preferably 0.1% to 5% of a $C_1$–$C_4$ alkanol such as ethanol;

0.1 % to 5%, more preferably 0.3% to 3% of a proton donating agent selected from the group consisting of hydroxy containing organic acids such as lactic acid, citric acid or ortho hydroxy benzoic acid and inorganic acids such as a sulfuric acid or hydrochloric acid and mixtures thereof;

0 to 1.5%, more preferably 0.3% to 1.5% of triethanol amine; and the balance being water, wherein the composition has a pH of 2.7 to 4.5, more preferably 3 to 4 and the composition does not contain an amine oxide surfactant, a cationic surfactant or an alkyl polyglucoside surfactant.

The disinfecting agent is selected from the group consisting of triclosan, perfumes, essential oils and mixtures thereof.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, Arbanex™, Arbanol®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, Fernlol™, Florilys™, Geraniol, Geranyl Acetate, Geranyl Nitrile, Glidmint™ Mint oils, Glidox™, Grapefruit oils, trans-2-Hexenal, trans-2-Hexenol, cis-3-Hexenyl Isovalerate, cis-3-Hexanyl-2-methylbutyrate, Hexyl Isovalerate, Hexyl-2-methylbutyrate, Hydroxycitronellal, lonone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo lonone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, Tetralol®, Tomato oils, Vitalizair, Zestoral™, Hinokitiol and Thujopsis Dolabrata™.

One of the nonionic surfactants used in the instant composition is a higher aliphatic, primary alcohol containing about 9–15 carbon atoms, preferably a $C_9$–$C_{11}$ alkanol condensed with 2 to 3 moles of ethylene oxide.

The other nonionic surfactant used in the instant composition is a higher aliphatic primary alcohol containing 9 to 15 carbon atoms, preferably a $C_9$–$C_{11}$ alkanol condensed with about 6 to about 9 moles, more preferably about 7 to about 8.5 moles of ethylene oxide.

The blend of cosurfactants consists of a $C_1$–$C_5$ alkyl ether of mono, di or triethylene glycol and a $C_1$–$C_5$ alkyl ether of mono, di or tripropylene glycol.

Satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

Water soluble solvent useful in the instant compositions are $C_1$–$C_4$ alcohols such as methanol, ethanol and isopropanol which can be used in blend with the aforementioned glycol ethers blends weight, wherein the ratios of glycol ethers and alcohol are 1:5 to 5:1, more preferably 1:1.

The instant composition contains 0.1% to 10%, more preferably 0.2% to 5%, by weight of an amphoteric surfactant. The amphoteric surfactant can be a water-soluble betaine having the general formula:

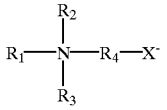

wherein $x^-$ is selected from the group consisting of $CO_2$- and $SO_3$- and $R_1$ is an alkyl group having 10 to about 20 carbon atoms, preferably 12 to 16 carbon atoms, or an amido radical:

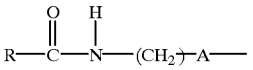

wherein R is an alkyl group having about 9 to 19 carbon atoms and a is the integer 1 to 4; $R_2$ and $R_3$ are each alkyl groups having 1 to 3 carbon atoms and preferably 1 carbon; $R_4$ is an alkylene or hydroxyalkylene group having from 1 to 4 carbon atoms and, optionally, one hydroxyl group. typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, plamityl dimethyl betaine, lauryl dimethyl betaine, cetyl dimethyl betaine, stearyl dimethyl betaine, etc. The amido betaines similarly include cocoamidoethylbetaine, cocoamidopropyl betaine and the like. A preferred betaine is coco ($C_8$–$C_{18}$) amidopropyl dimethyl betaine. Two preferred betaine surfactants are Rewoteric AMB 13 and Golmschmidt betaine L7.

The preferred anionic surfactant used in the instant composition is a paraffin sulfonates containing 10 to 20, preferably 13 to 17 carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188 and German Patent 735,096.

The pH of the composition will be adjusted to pH 2.7 to 4.5, preferably 3 to 4 with NaOH, KOH, but preferably with an organic alkalinity donor which will not leave streaks such as diethanolamine or triethanolamine.

The final essential ingredient in the inventive compositions having improved interfacial tension properties is water. The proportion of water in the compositions generally is in the range of 20% to 97%, preferably 70% to 97% by weight.

In addition to the above-described essential ingredients, the compositions of this invention may often and preferably do contain one or more additional ingredients which serve to improve overall product performance.

The multi purpose liquid cleaning composition of this invention may, if desired, also contain other components either to provide additional effect or to make the product more attractive to the consumer. The following are mentioned by way of example: Colors or dyes in amounts up to 0.5% by weight, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In their final form, the multi purpose liquids are clear compositions and exhibit stability at reduced and increased temperatures. More specifically, such compositions remain clear and stable in the range of 5° C. to 50° C., especially 10° C. to 43° C.

The compositions are directly ready for use as desired and only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged in a pump-type sprayer for the so-called spray-and-wipe type of application. The composition can also be dispensed from a non woven or fabric towel which can be used once and discarded or reused several times with adequate rinsing between usage.

Because the compositions as prepared are aqueous liquid formulations, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. It is not necessary to use elevated temperatures in the formation step and room temperature is sufficient.

The instant formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification 5 are by weight.

EXAMPLE 1

The following compositions in wt. % were prepared by simple mixing procedure:

| | 1 | 2 | 3 |
|---|---|---|---|
| Lactic acid | 1.5 | 1 | 1.5 |
| C9–C11 alcohol EO 2.5:1 nonionic surfactant | 0.2 | 0.2 | 0.2 |
| C13–17 Parafin sulfonate | 1.2 | 1.2 | 0.6 |
| Diethylene glycol N-butyl ether | 2 | 2 | 2 |
| Cocoamido propyl dimethyl betaine | 0.45 | 0.45 | 0.45 |
| Propylene glycol n-butyl ether | 2 | 2 | 2 |
| Ethanol | 2 | 2 | 2 |
| Triethanol amine | 0.8 | 0.57 | 1.0 |
| Perfume | 0.4 | 0.4 | 0.4 |
| Water | Bal. | Bal. | Bal. |
| Ph | 3.5 | 3.5 | 3.5 |
| Disinfecting results neat EN 1276 Staphylococcus aureus | pass | pass | pass |
| degreasing test neat | good | good | good |
| Residue | good | good | good |
| oil uptake oil level/surfactant level | 1.42 | | |

The test protocol used to assess disinfection is the well known European EN 1276 test which uses a strain of bacteria, a short contact time and calls for a bacteria count reduction of 5 log.

In summary, the described invention broadly relates to an improved microemulsion composition containing an anionic surfactant, a nonionic surfactant and an amphoteric surfactant, a water soluble solvent, a hydrocarbon ingredient, a proton donating agent and water.

What is claimed:

1. A microemulsion composition comprising approximately by weight:

(a) 0.1% to 5% of a proton donating agent, (b) 0 to 4% of at least one disinfecting agent, wherein said disinfecting agent is selected from the group consisting of triclosan, perfumes and essential oils and mixtures thereof;

(c) 0 to 10% of an ethoxylated nonionic surfactant formed from a $C_9$–$C_{11}$ alkanol and about 6 to about 9 moles of ethylene oxide;

(d) 0.1% to about 4.0% of an ethoxylated nonionic surfactant formed from a $C_9$–$C_{11}$ alkanol and about 2 to about 3 moles of ethylene oxide;

(e) 0.1% to 10% of an amphoteric surfactant;

(f) 1.0% to 10% of at least two different glycol ethers, wherein one of said glycol ethers is a propylene glycol alkyl ether, wherein the alkyl group has 1 to 5 carbon atoms and the other glycol ether is an ethylene glycol alkyl ether, wherein the alkyl group has 1 to 5 carbon atoms;

(g) an anionic surfactant; and (h) the balance being water, wherein the composition does not contain an amine oxide surfactant, a cationic surfactant or an alkyl polyglucoside surfactant.

2. The composition according to claim 1, further including a $C_1$–$C_4$ alkanol.

3. The composition according to claim 2, wherein one of said glycol ether is propylene glycol N-butyl ether.

4. The composition according to claim 1, wherein said proton donating agent is a hydroxy containing organic acid.

* * * * *